US006733254B1

(12) United States Patent
Yen

(10) Patent No.: US 6,733,254 B1
(45) Date of Patent: May 11, 2004

(54) AIR PUMPING/EXTRACTING DUPLEX PUMP

(76) Inventor: Stanley Yen, 3F, No. 44-2, Lane 260, Kwang Fu South Rd., Taipei (TW)

( * ) Notice: Subject to any disclaimer, the term of this patent is extended or adjusted under 35 U.S.C. 154(b) by 7 days.

(21) Appl. No.: 10/207,235

(22) Filed: Jul. 30, 2002

(51) Int. Cl.[7] ..... F04B 35/04

(52) U.S. Cl. ..... 417/423.1; 417/357; 417/410.1; 417/510; 415/206

(58) Field of Search ..... 417/357, 363, 417/410.1, 423.1, 510, 320, 355, 360, 361, 423.11, 423.14, 506, 507, 508; 415/206, 182.1, 196, 197, 203, 213.1

(56) References Cited

U.S. PATENT DOCUMENTS

2003/0099560 A1 * 5/2003 Wang

FOREIGN PATENT DOCUMENTS

WO WO-02/082955 A1 * 10/2002

* cited by examiner

*Primary Examiner*—Justine R. Yu
*Assistant Examiner*—John F. Belena
(74) *Attorney, Agent, or Firm*—Donald C. Casey

(57) ABSTRACT

An air pumping/extracting duplex pump for use in an inflatable device for selectively pumping air into/out of an air chamber of an inflatable device is constructed to include two connected housing, and an actuating mechanism mounted in the housings and manually rotatable between a first position for drawing air into the inflatable device and a second position for drawing air out of the inflatable device.

5 Claims, 4 Drawing Sheets

AIR PUMPING/EXTRACTING DUPLEX PUMP

BACKGROUND OF THE INVENTION

1. Field of the Invention

The present invention relates to an air pump and, more specifically, to an air pumping/extracting duplex pump adapted for use in an inflatable device to selectively inflate/deflate the inflatable device.

2. Description of the Related Art

When inflatable/deflating a big inflatable device, an air pump is used. A big inflatable device generally has a first one-way air valve for enabling air to pass to the inside, and a second one-way air valve for enabling air to pass to the outside. When inflating this kind of big inflatable device with an air pump, the air exhaust port of the air pump is connected to the first one-way air valve of the inflatable device. On the contrary, when deflating this kind of big inflatable device with an air pump, the air suction port of the air pump is connected to the second one-way air valve of the inflatable device. This inflatable device inflating or deflating procedure is complicated.

SUMMARY OF THE INVENTION

The present invention has been accomplished under the circumstances in view. It is one object of the present invention to provide a duplex pump, which is practical for use in an inflatable device to selectively inflate/deflate the inflatable device. It is another object of the present invention to provide an air pumping/extracting duplex pump, which is easy to operate. To achieve these and other objects of the present invention, the air pumping/extracting duplex pump is installed in an inflatable device having a flexible shell defining an air chamber, and adapted for selectively pumping air into/out of the air chamber of the inflatable device. The air pumping/extracting duplex pump is comprised of a first housing, a second housing, and an actuating mechanism. The first housing is fixedly fastened to the flexible shell of the inflatable device, comprising an air chamber, an air inlet and an air outlet respectively disposed in communication between the air chamber of the first housing and the air chamber of the inflatable device, a first one-way air valve installed in the air outlet for enabling air to pass from the air chamber of the first housing into the air chamber of the inflatable device, and a second one-way air valve installed in the air inlet for enabling air to pass from the air chamber of the inflatable device into the air chamber of the first housing. The second housing is fixedly fastened to the first housing and extended to the outside of the inflatable device, comprising an air chamber disposed in communication with the air chamber of the first housing, a first opening disposed in communication with the air chamber of the second housing and the atmosphere, a second opening disposed in communication with the air chamber of the second housing and the air chamber of the first housing, and an annular airflow control plate fixedly fastened to the periphery of the second opening, the annular airflow control plate having a radially inwardly protruded first stop flange and at least one radially inwardly protruded second stop flange. The actuating mechanism is mounted in the first housing and the second housing and rotatable relative to the first housing and the second housing between a first position for drawing air into the air chamber of the inflatable bed and a second position for drawing air out of the air chamber of the inflatable device. The actuating mechanism comprises an outward flange supported on the airflow control plate, a first part disposed at one side of the outward flange inside the air chamber of the first housing, and a second part disposed at an opposite side of the outward flange inside the air chamber of the second housing, the first part having an air suction hole, an air exhaust hole, and a protruded portion, the outward flange having a first air hole disposed in communication with the exhaust hole and at least one second air hole disposed in communication between the first part and the second part. When the actuating mechanism rotated to the first position, the first stop flange of the airflow control plate blocks the first air hole of the actuating mechanism, the at least one second air hole of the actuating mechanism each is opened, and the air exhaust hole of the actuating mechanism is in communication with the air outlet of the first housing for enabling outside air to be drawn into the air chamber of the inflatable device upon operation of the actuating device. When the actuating mechanism rotated to the second position, the protruded portion of the actuating mechanism opens the second one-way air valve, the air exhaust hole of the actuating mechanism is moved away from the air outlet of the first housing and blocked by the periphery of the first housing, the first air hole of the actuating mechanism is moved away from the first stop flange of the airflow control plate and opened, and the at least one second air hole is respectively blocked by the at least one stop flange of the airflow control plate, enabling air to pass from the air chamber of the inflatable device through the air inlet of the first housing, the air chamber of the first housing, the first air hole of the actuating mechanism, the air chamber of the second housing, and the first opening of the second housing to the outside of the inflatable device.

DETAILED DESCRIPTION OF THE PREFERRED EMBODIMENT

Figure 1:
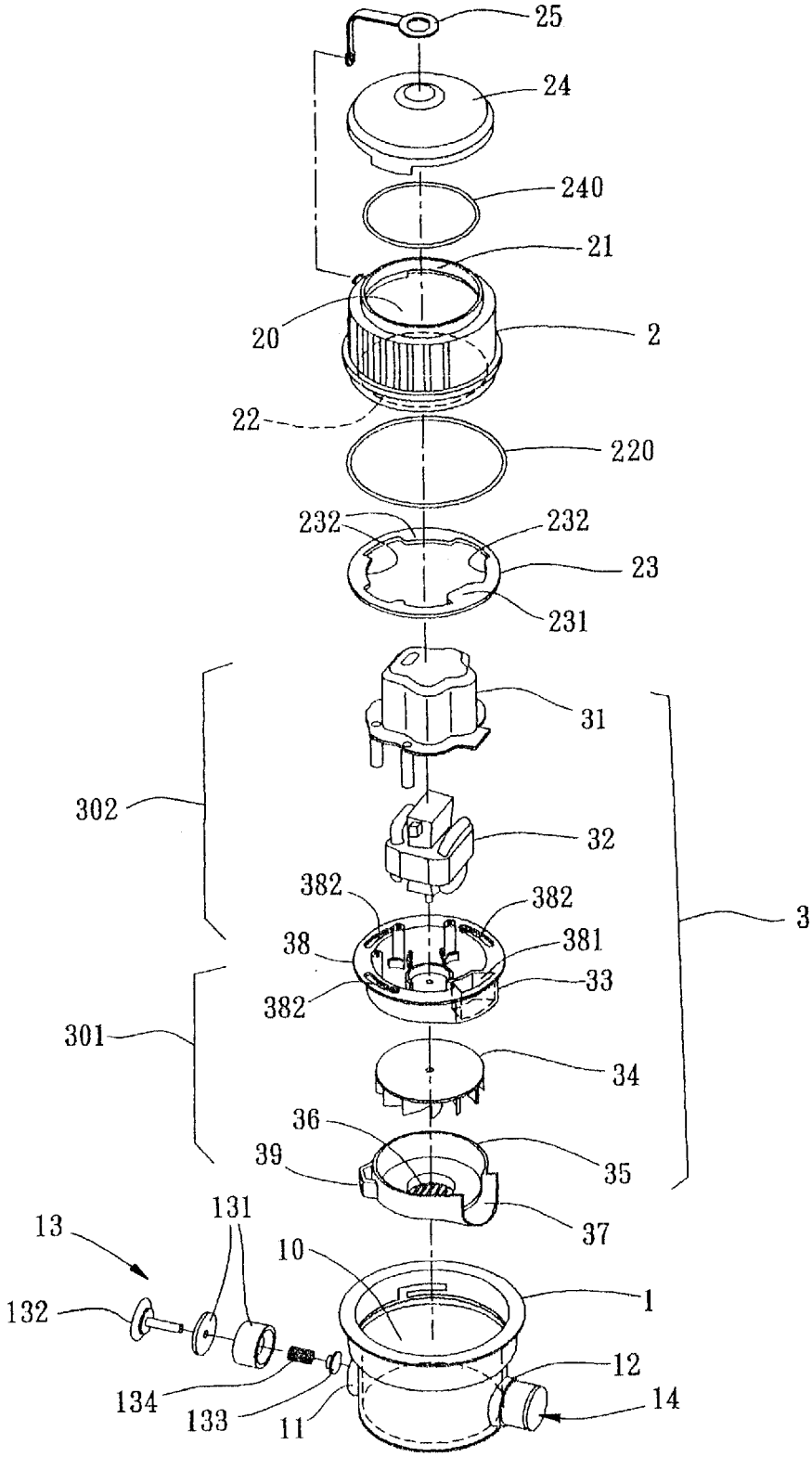
FIG. 1 is an exploded view of an air pumping/extracting duplex pump according to the present invention.
Figure 2:
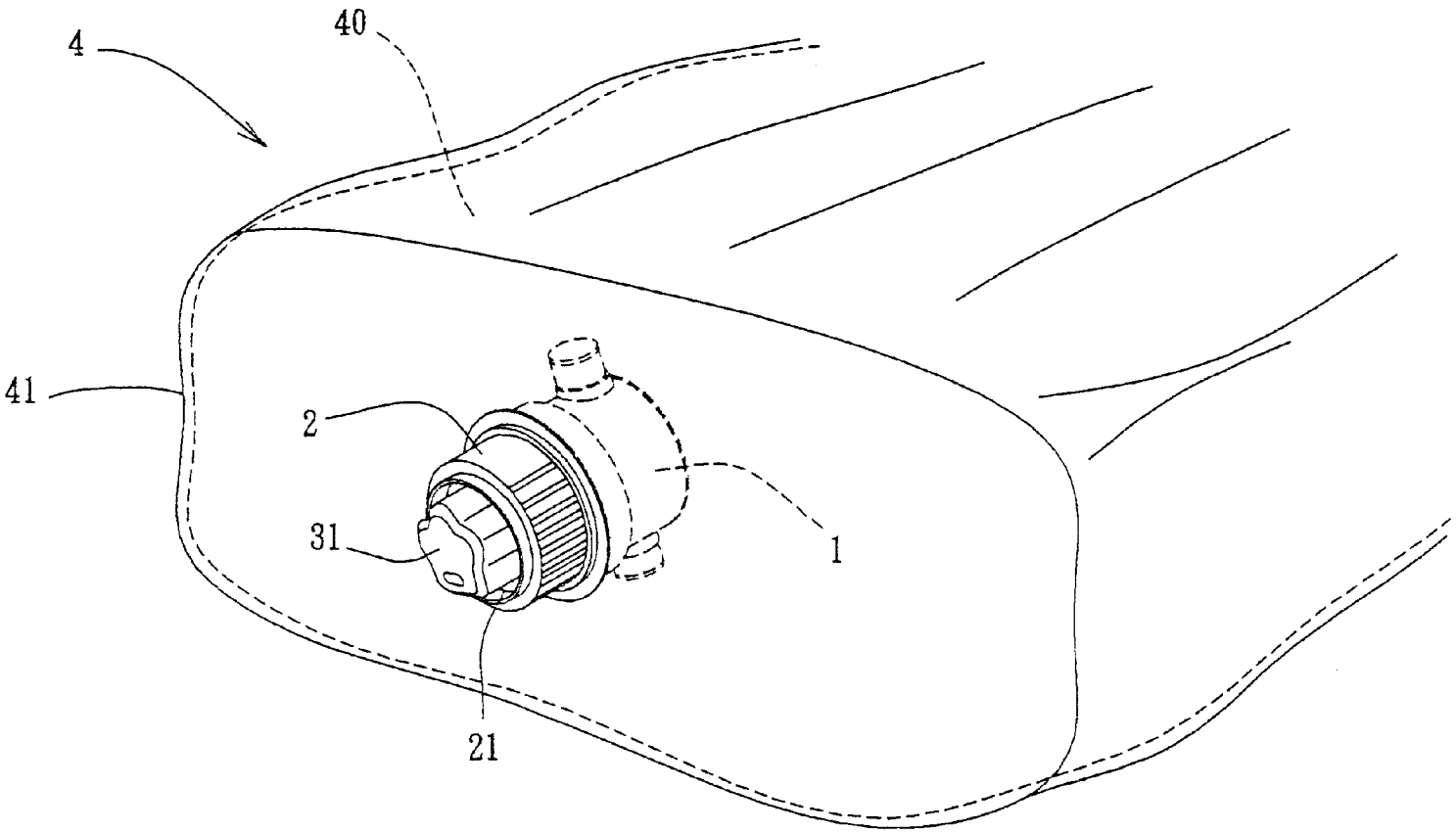
FIG. 2 is an applied view of the present invention, showing the air pumping/extracting duplex pump installed in an air bed.

Referring to FIGS. 1 and 2, an air pumping/extracting duplex pump in accordance with the present invention is generally comprised of a first housing 1, a second housing 2, and an actuating mechanism 3. The air pumping/extracting duplex pump can be used in, for example, an inflatable air bed 4. The inflatable air bed 4 comprises a collapsible plastic shell 41 defining an air chamber 40. The air pumping/extracting duplex pump is adapted to inflate/deflect the air bed 4.

The first housing 1 is fixedly fastened to the collapsible plastic shell 41 of the air bed 4 by a heat sealing apparatus and suspended inside the air chamber 40, having an air chamber 10, an air inlet 12 and an air outlet 11 respectively disposed in communication between the air chamber 10 of the first housing 1 and the air chamber 40 of the air bed 4, a first one-way air valve 13 installed in the air outlet 12 for enabling air to pass from the air chamber 10 of the first housing 1 into the air chamber 40 of the air bed 4, and a second one-way air valve 14 installed in the air inlet 12 for enabling air to pass from the air chamber 40 of the air bed 4 into the air chamber 10 of the first housing 1. The first one-way air valve 13 is comprised of a fixed casing 131 fixedly fastened to the air outlet 11 of the first housing 1, a movable valve rod 132 inserted through the fixed casing 131, a stopper 133 fixedly fastened to one end of the movable valve rod 132 and adapted for stopping the air passage through the air outlet 11, and a spring 134 connected between the casing 131 and the stopper 133 and adapted for supporting the stopper 133 in the close position to close the air passage through the air outlet 1. The structure of the second one-way air valve 14 is similar to the first one-way air valve 13 with the exception of its reversed installation direction.

The second housing 2 is fastened to the first housing 1 and extended to the outside of the inflatable air bed 4, having an air chamber 20 disposed in communication with the air chamber 10 of the first housing 1, a first opening 21 disposed in communication with the air chamber 20 and the atmosphere, a second opening 22 disposed in communication with the air chamber 20 of the second housing 2 and the air chamber 10 of the first housing 1, and an annular airflow control plate 23 fixedly fastened to the periphery of the second opening 22 by a heat sealing apparatus and O-ring 220. The annular airflow control plate 23 has one first stop flange 231 and at least one, for example, three second stop flanges 232. The stop flanges 231;232 are radially inwardly protruded from the inner diameter of the annular airflow control plate 23 into the air chamber 20.

The actuating mechanism 3 according to the present preferred embodiment is a centrifugal fan comprising a rotary base 31, a fan motor 32, a motor holder 33 fixedly fastened to the rotary base 31 and holding the fan motor 32 on the inside, a fan blade 34 disposed outside the motor holder 33 and coupled to the fan motor 32, and a cover 35 fixedly fastened to the motor holder 33 and covered over the fan blade 34. The cover 35 has a center air suction hole 36, a radial exhaust hole 37, and a protruded portion 39. The motor holder 33 has an outward flange 38 supported on the annular airflow control plate 23. The outward flange 38 divides the whole actuating mechanism 3 into a first part 301 suspended in the air chamber 10 of the first housing 1 and a second part 302 suspended in the air chamber 20 of the second housing 2. Therefore, the center air suction hole 36 and radial exhaust hole 37 of the cover 35 are disposed is in the air chamber 10 of the first housing 1. Further, the outward flange 38 of the motor holder 33 has a first air hole 381 disposed in communication with the radial exhaust hole 37 of the cover 35, and a plurality of second air holes 382 disposed in communication between the first part 301 and the second part 302.

When installed in the inflatable air bed 4 as shown in FIG. 2, the rotary base 31 is extended out of the first opening 21 of the second housing 2 for operation by the user, and the actuating mechanism 3 is disposed inside the first housing 1 and the second housing 2 on the middle and rotatable relative to the first housing 1 and the second housing 2 between a first position and a second position.

Figure 3:
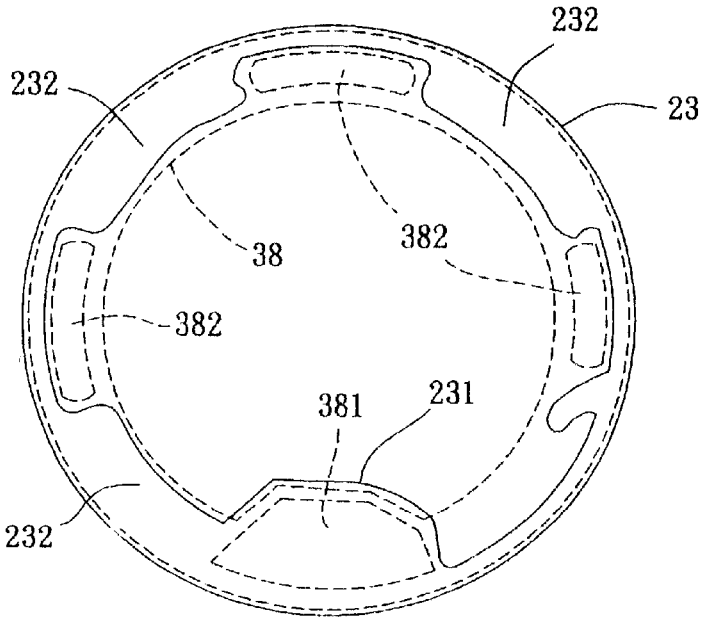
FIG. 3 is a schematic drawing showing the relative positioning between the airflow control plate and the outward flange of the motor holder of the actuating mechanism during inflating mode.
Figure 4:
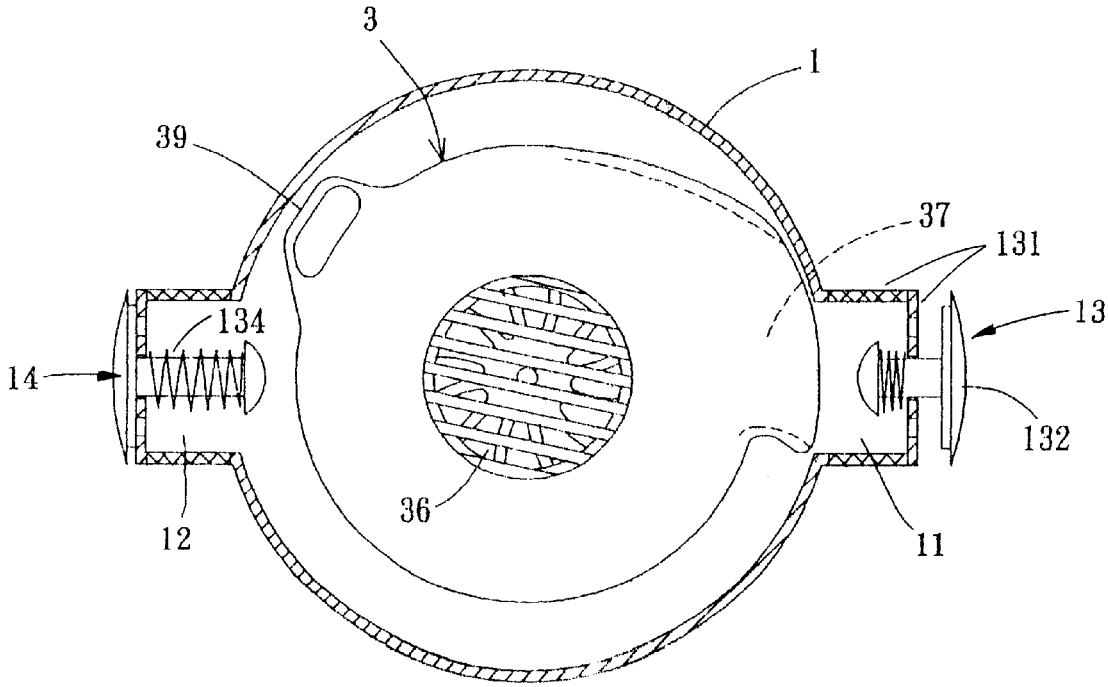
FIG. 4 is a schematic drawing showing the relative positioning between the actuating mechanism and the first housing during inflating mode.

Referring to FIGS. 3 and 4 and FIG. 1 again, when the actuating mechanism 3 manually rotated to the first position, the first stop flange 231 of the annular airflow control plate 23 blocks the first air hole 381 of the motor holder 33, leaving the second air holes 382 opened, and the radial exhaust hole 37 of the cover 35 is abutted against the air outlet 1 of the first housing 1. At this time, outside air passes through the first opening 21 of the second housing 2 into the air chamber 20 of the second housing 2, and then passes through the second air holes 382 of the motor holder 33 into the air chamber 10 of the first housing 1, and then passes from the air chamber 10 of the first housing 1 through the center air suction hole 36 and then the radial exhaust hole 37 to rush open the first one-way air valve 13 and then to pass to the inside of the air chamber 40 of the inflatable air bed 4, and therefore the inflatable air bed 4 is inflated.

Figure 5:
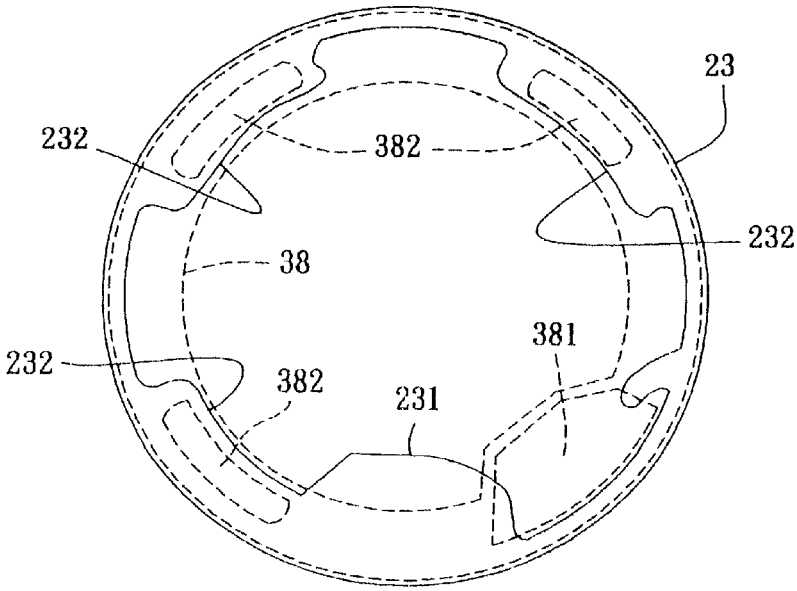
FIG. 5 is a schematic drawing showing the relative positioning between the airflow control plate and the outward flange of the motor holder of the actuating mechanism during deflecting mode.
Figure 6:
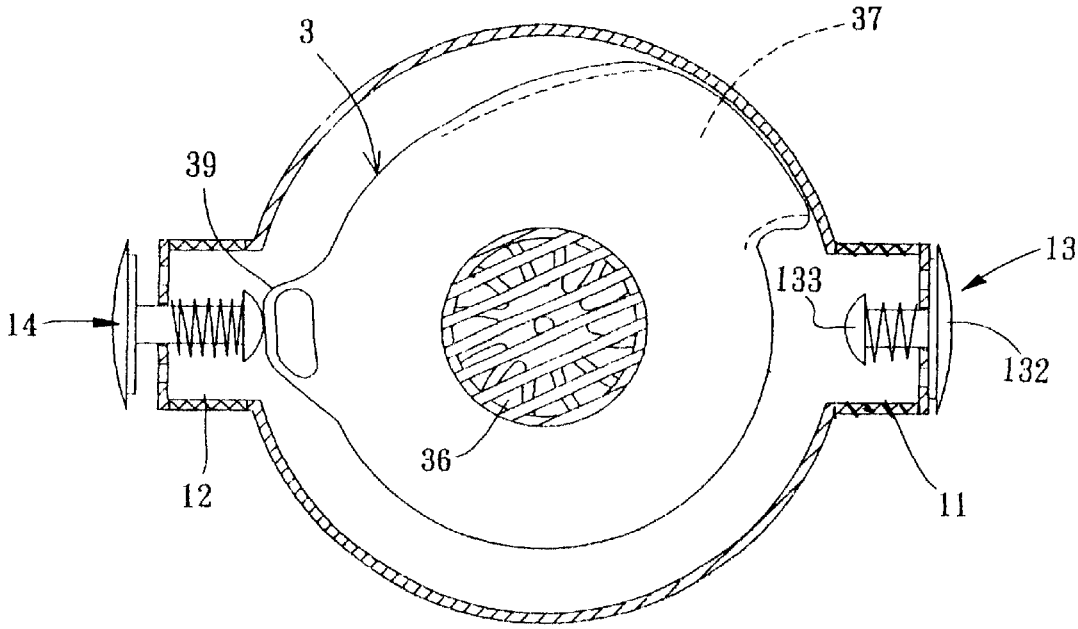
FIG. 6 is a schematic drawing showing the relative positioning between the actuating mechanism and the first housing during deflecting mode.

Referring to FIGS. 5 and 6 and FIG. 1 again, when the actuating mechanism 3 manually rotated to the second position, the protruded portion 39 is forced into the air inlet 11 of the first housing 1 to open the second one-way air valve 13; the radial exhaust hole 37 is moved away from the air outlet 11 of the first housing 1 and blocked by the peripheral wall of the first housing 1*m* the first air hole 381 is moved away from the first stop flange 231 of the airflow control plate 23 and opened; and the second air holes 382 are respectively blocked by the second stop flanges 232 of the airflow control plate 23. At this time, air passes from the air chamber 40 of the inflatable air bed 4 through the air inlet 12 of the first housing 1 into the air chamber 10 of the first housing 1, and then passes from the air chamber 10 of the first housing 1 through the center air suction hole 36 of the cover 35 to the air chamber 20 of the second housing 2 via the first air hole 381 of the motor holder 33, and then passes from the air chamber 20 of the second housing 2 to the outside through the first opening 21 of the second housing 2, and therefore the inflatable air bed 4 is deflated.

Referring to FIG. 1 again, a cap 24 is connected to the second housing 2 with O-ring 240 by a link 25, and adapted for closing the first opening 21 of the second housing 2 to protect the actuating mechanism 3.

A prototype of air pumping/extracting duplex pump has been constructed with the features of FIGS. 1–6. The air pumping/extracting duplex pump functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An air pumping/extracting duplex pump installed in an inflatable device having a flexible shell defining an air chamber and adapted for selectively pumping air into/out of the air chamber of said inflatable device comprising:

a first housing fixedly fastened to the flexible shell of said inflatable device, said first housing comprising an air chamber, an air inlet and an air outlet respectively disposed in communication between the air chamber of said first housing and the air chamber of said inflatable device, a first one-way air valve installed in said air outlet for enabling air to pass from the air chamber of said first housing into the air chamber of said inflatable device, and a second one-way air valve installed in said air outlet for enabling air to pass from the air chamber of said inflatable device into the air chamber of said first housing;

a second housing fixedly fastened to said first housing and extended to an outside of said inflatable device, said second housing comprising an air chamber disposed in communication with the air chamber of said first housing, a first opening disposed in communication with the air chamber of said second housing and the atmosphere, a second opening disposed in communication with the air chamber of said second housing and the air chamber of said first housing, and an annular airflow control plate fixedly fastened to the periphery of said second opening, said annular airflow control plate having a radially inwardly protruded first stop flange and at least one radially inwardly protruded second stop flange;

an actuating mechanism mounted in said first housing and said second housing and rotatable relative to said first housing and said second housing between a first position for drawing air into the air chamber of said inflatable device and a second position for drawing air out of the air chamber of said inflatable device, said actuating mechanism having an outward flange supported on said airflow control plate, a first part disposed at one side of said outward flange inside the air chamber of said first housing, and a second part disposed at an opposite side of said outward flange inside the air chamber of said second housing, said first part having an air suction hold, an air exhaust hole, and a protruded portion, said outward flange having a first air hole disposed in communication with said exhaust hole and at least one second air hole disposed in communication between said first part and said second part;

when said actuating mechanism rotated to said first position, said first stop flange of said airglow control plate blocks the first air hole of said actuating mechanism, said at least one second air hole of said actuating mechanism is opened to airflow and said air exhaust hole of said actuating mechanism is in communication with said air outlet of said first housing for enabling outside air to be drawn into the air chamber of said inflatable device upon operation of said actuating mechanism;

when said actuating mechanism rotated to said second position, said protruded portion of said actuating mechanism opens said second one-way air valve, said air exhaust hole of said actuating mechanism is moved away from said air outlet of said first housing and blocked by a periphery wall of said first housing, said first air hole of said actuating mechanism is moved away from said first stop flange of said airflow control plate and opened to airflow, and said at least one second airflow control plate, enabling air to pass from the air chamber of said inflatable device through said air inlet of said first housing, the air chamber of said first housing, said first air hole of said actuating mechanism, the air chamber of said second housing, and the first opening of said second housing to the outside of said inflatable device.

2. The air pumping/extracting duplex plump as claimed in claim 1, wherein said actuating mechanism comprises a rotary base, a motor holder fixedly fastened to said rotary base, a fan motor mounted in said motor holder, a fan blade coupled to said fan motor, and a cover fixedly fastened to said motor holder around said fan blade, said cover having said air suction hole and said air exhaust hold formed therein.

3. The air pumping/extracting duplex pump as claimed in claim 1, wherein said first one-way air valve comprises a fixed casing fixedly fastened to said air outlet of said first housing, a movable valve rod inserted through said fixed casing, a stopper fixedly fastened to one end of said movable valve rod and adapted for partially stopping said air outlet, and a spring connected between said casing and said stopper to bias said valve rod in a close position closing said air outlet.

4. The air pumping/extracting duplex pump as claimed in claim 1, wherein said second one-way air valve comprises a fixed casing fixedly fastened to said air outlet of said first housing, a movable valve rod inserted through said fixed casing, a stopper fixedly fastened to one end of said movable valve rod and adapted for partially stopping said air outlet, and a spring connected between said casing and said stopper to said bias stopper bias said valve rod in a close position closing said air outlet.

5. The air pumping/extracting duplex pump as claimed in claim 1, further comprising a cap adapted for closing said first opening of said second housing, and a link connected between said cap and said second housing.

* * * * *